United States Patent [19]

Baader et al.

[11] 4,042,820

[45] Aug. 16, 1977

[54] MOLDED LAMP HOUSING

[76] Inventors: Joseph E. Baader, 333 Holiday Drive, Springfield, Ohio 44505; Edward J. Baader, 711 E. Cecil, Springfield, Ohio 45503

[21] Appl. No.: 701,716

[22] Filed: July 1, 1976

[51] Int. Cl.[2] ..... F21V 21/00

[52] U.S. Cl. ..... 240/52 R; 240/7.1 R

[58] Field of Search ..... 240/52 R, 7.1 R

[56] References Cited

U.S. PATENT DOCUMENTS

| | | | |
|---|---|---|---|
| 2,115,600 | 4/1938 | Weston | 240/52 R |
| 3,118,616 | 1/1964 | Magazanik | 240/7.1 R |
| 3,125,299 | 3/1964 | Woofter | 240/7.1 R |
| 3,227,869 | 1/1966 | Heenan | 240/52 R |

*Primary Examiner*—Monroe H. Hayes
*Attorney, Agent, or Firm*—David H. Semmes

[57] ABSTRACT

A molded lamp housing for vehicular application, requiring no wires for making electrical connections to a lamp socket, with all electrical contact pieces molded in place. The entire bulb mounting is accomplished through a single screw connection which also serves as a grounding connection. Significantly, the problem of corrosion build-up on either the bulb contact or ground strap is obviated, since normal vehicle vibration of the bulb will cause a wiping action to inhibit such a build-up.

16 Claims, 3 Drawing Figures

MOLDED LAMP HOUSING

BACKGROUND OF THE INVENTION

1. Field of the Invention

A bayonet-type bulb mounting assembly of the type commonly employed on large vehicles, such as school buses, in which conventional vehicular lamp housings require separately wired sockets for securing a bayonet-type bulb, and the bulb contacts are subject to galvanic and oxidation corrosion from the inhospitable environment of vehicle operation. The present invention takes advantage of previously troublesome realities of vehicle operation, by providing a lamp housing that avoids corrosion build-up through a wiping action in response to vehicle vibrations.

2. Description of the Prior Art

Various forms of bayonet-type lamp sockets are known in the prior art, and various structures to avoid corrosion of bulb contacts in vehicular use have been proposed. Exemplary of the prior art are the following U.S. Pat. Nos. MOORE 3,858,038; HESS 3,819,926; FREEMAN 3,813,535; RILEY 3,780,282; NEWMAN 3,748,462; PLOEGER 3,739,168; DUPREE 3,602,708; ALTISSIMO 3,489,891; QUELLAND 3,300,636; CHENG 3,246,136; SCHUMACHER 2,980,791; BALDWIN 2,853,595; MEARS 2,786,129; BENANDER 2,292,038; DEL CAMP 2,225,584; FRASER 2,069,238; WOOD 1,977,105.

The patent to Moore illustrates a form of submersible vehicle lamp assembly with a conventional bayonet connector requiring separate wire leads to an ultimate electrical connection. As such, Moore represents the typical bulb mounting which is used in the art.

Hess illustrates a similar empolyment of a conventional bayonet mount within a vehicle lamp assembly.

The patent to Freeman illustrates another form of clip to hold the base of a bayonet-type bulb in a surrounding relation against vibratory movement.

The patent to Riley shows a sealed tail light construction that also includes a conventional bayonet bulb socket.

The Ploeger construction relies upon another form of spring to securely urge the base portion of a bayonet-type bulb against a surrounding bayonet socket configuration.

Newman mounts a bayonet type bulb by a conventional bayonet receptacle, with his disclosed novelty residing in a molded junction box. Newman also illustrates separate wire interconnections between the bulb socket and a junction box, unlike the bulb-mounting taught by the present invention.

The patent to Dupree employs a conventional spring mounted bayonet base where the novelty is in the method for forming the separate sleeve and center pin for a wire connection. The conventional bayonet bulb mount of Dupree also does not provide for a structure that will allow automatic wiping against corrosion build-up, as taught herein.

The vehicle lamp holder of Altissimo also includes a conventional bayonet mounting wherein the bayonet pins on the bulb are held tightly against movement.

The patent to Quelland is, once again, a conventional bayonet lamp socket with a spring loaded connection between the entire socket assembly and a mounting receptacle. The parking light of Cheng has a screw-in bulb connection, unlike the present invention and further illustrates conventional wiring between a bulb socket and the vehicle. The patent to Schumacher illustrates a molded plastic bayonet mount that rigidly holds the bulb in place without allowing for a wiping movement in response to vibration during vehicle operation. The springed contact 24 in Schumacher urges the bayonet pin base against the cooperating bayonet socket to ensure a rigid mounting.

The patent to Mears teaches a mounting for a conventional bayonet socket with a particularized form of elastic snap ring. Again, such a conventional socket cannot take advantage of automotive vibrations to maintain a bulb contact free from corrosion.

The patent to Baldwin shows a non-analogous embedded pin-type light assembly, also rigidly mounted within a socket member.

The patents to Benander and Wood yet further illustrate conventional screw-in lamp socket designs, wherein a bulb is rigidly held through a screw thread. Such conventional screw-in sockets provide no means for avoiding corrosion build-up. Similarly, the the patents to Fraser and Del Camp further represent known forms of conventional bayonet socket mounts without the provision of a structure which will ensure automatic wiping against corrosion build-up.

In summary, none of the above references begin to teach a structure which provides for particularly economical molded lamp mounting, and one which allows a wiping action from the vibrations of vehicular operation against corrosion.

SUMMARY OF THE INVENTION

The present invention relates to a completely molded lamp housing for holding a bayonet-type bulb in a particularly unique manner. The present invention may also be considered a vehicular lamp housing, of the type commonly found on large vehicles such as school buses. The entire lamp housing is integrally molded with all appropriate electrical contacts, and associated individual elements, requiring no conventional wiring between the bayonet bulb and an external source of power. It is a significant object of the present invention to provide a vehicular lamp housing assembly that will avoid the necessity for individually wiring a socket assembly to the vehicle, while ensuring that electrical contacts are wiped free of corrosion and dirt while externally mounted on a vehicle surface.

The present invention is characterized by a housing base that includes an integrally molded extending contact assembly. This extending contact assembly functions as the support means for a bayonet-type bulb and also provides a rigid mounting platform for an integrated contact stip. The present invention takes advantage of a particular configuration for the bayonet-type bulb mounting, one which allows the bulb to pivot about the bayonet pins in response to vibrations encountered during vehicle operation. By way of background, bayonet-type bulbs are widely used in vehicle applications, constituting usually a 12 volt bulb having a pair of diametrically extending pins around its base. The bayonet pins are normally inserted into a cylinder metal housing that includes a spiral channel to form a click lock configuration. The cylindrical housing is conventionally of metal, so that the ground connection of the bayonet bulb is made through the contacts of the bulb base within the metallic housing. The positive electrical connection for the bayonet bulb is then made through a spring loaded and electrically insulated contact within the base of the surrounding metal housing. Consequently, bayonet-type bulbs are rigidly urged into a locking position by the action of the positive electrical contact located in the base of the socket. Because this positive electrical socket assembly urges the bayonet pins into tight engagement within the corresponding bayonet detent, the bulb is quite rigidly held in the socket.

In distinction, the present invention does not hold a bayonet-type bulb rigidly with an encompassing bayonet-type socket, but rather takes advantage of the geometry of the bayonet-type bulb in a completely different manner.

The present invention teaches a molded lamp housing comprised of a molded plastic contact assembly to allow for a pivoting action of the bulb, with the pivoting action being retarded only by a contact with a cantilevered ground strap. The cantilevered ground strap functions both to make a ground connection between the bulb and the vehicular electrical system, and afford the sole means for holding the bayonet-type bulb within the bulb support.

The present molded lamp housing does not require that a separate socket be wired into the vehicle electrical system, but constitutes a significantly improved lamp housing for vehicular application. The present invention teaches a particularly economical mounting for a bayonet-type bulb in vehicle applications which significantly avoids the problem of corrosion build up through a natural wiping action that is the direct result of the structure taught herein. Therefore, the present invention obtains a synergistic result from a cooperation of elements; corrosion is obviated as a natural consequence of the environment to which the present invention is directed.

Other advantages of the molded lamp housing taught herein will be more apparent from considering the detailed description which follows, in which reference is made to the accompanying drawings.

DESCRIPTION OF THE PREFERRED EMBODIMENT

Figure 1:
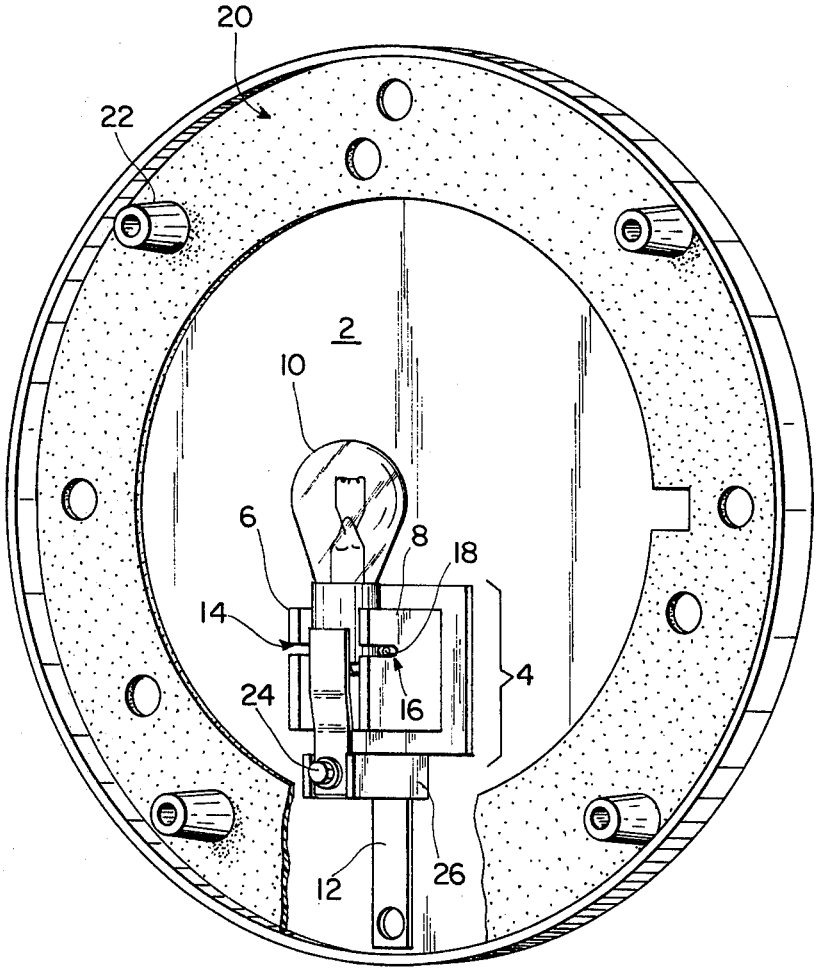
FIG. 1 is a respective view showing the preferred embodiment of the present invention.

The preferred embodiment for the present invention is illustrated in FIG. 1 to include a housing base 2, which is of an electrically insulating material such as plastic. The housing base 2 includes a first surface that has an integrally formed bulb support extending outwardly, as shown broadly at 4. The bulb support 4 is preferably an integrally molded extension on the first surface of the housing 2, though it may be attached to the housing by a subsequent manufacturing operation. The bulb support 4 is further defined by a concave channel recess that is defined by a pair of oppositely disposed extensions of the base, shown at 6 and 8 in FIG. 1. The extension 6 and 8 therefore define an outwardly open concave channel recess, wherein the recess is substantially parallel to the first surface of the base 2 for the purposes which will be more particularly described hereafter.

The mount extension 6 includes an outwardly open aperture 14, extending inwardly from the outer surface of the extension 6. In like fashion, another outwardly open aperture extends inwardly from the outer surface of the oppositely disposed extension 8. As shown in FIG. 1, these apertures are configured to allow the pins 18 on a conventional bayonet-type bulb 10 to be normally inserted. After the bulb 10 has been partially inserted into the concave recess within the bulb support, a ground strap 12 is then positioned as the sole holding means for the bulb. The ground strap 12 is shown to include a ground strap mounting extension 26, and the mounting screw at 24. In this fashion, the ground strap is cantilevered over the base of the bayonet bulb 10 from a point at 24 which is radially outward and parallel with the center line of the so positioned bulb 10. As further shown in FIG. 1, the housing base 2 has a substantially circular first surface, including a flange surface at its periphery together with locating pins 22 and a conventional form of sealing gasket 20.

Figure 2:
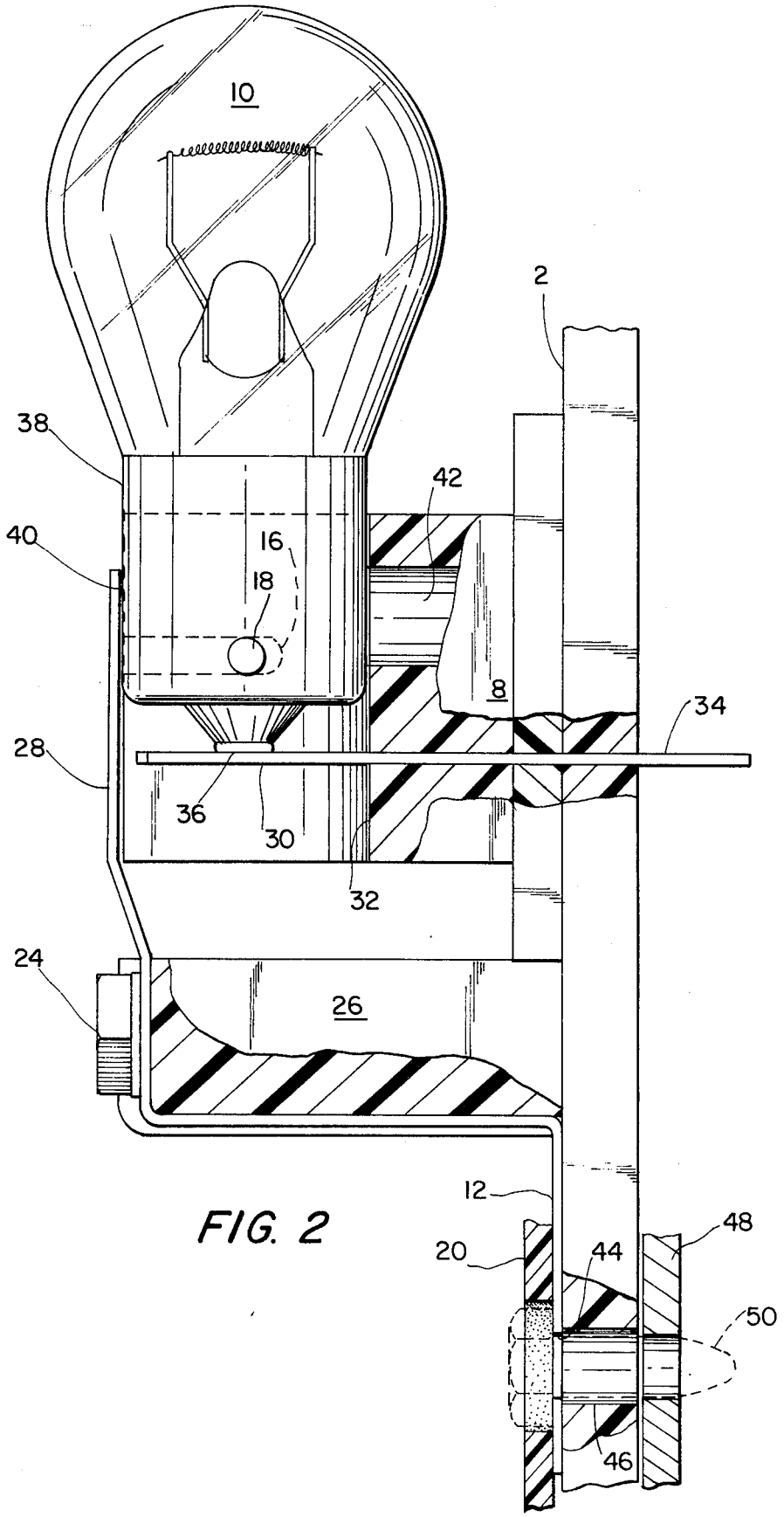
FIG. 2 is a partial section view of this preferred embodiment.

With reference to FIG. 2, further constructional details of the present invention can be more fully appreciated, particularly the interaction of the cantilevered metallic contact strip 30 which supplies a relatively positive electrical charge to the bayonet bulb. As shown most clearly in FIG. 2, the ground strap 12 includes a cantilevered portion 28 that extends above and in substantial parallel alignment to concave channel recess 32. As a consequence of this alignment, there is a line contact between the underside of the cantilevered portion of the ground strap 28 and the base of the bulb 38. The planar undersurface of the ground strap 28 will contact the circular configuration of the bulb base 38, as shown at 40. When the bulb 10 is substantially parallel to the first surface of the housing 2, there will be a line contact defined between the underside of the cantilevered ground strap 28 and the circular surface of the bulb base 38. For any rotation of the base 38 around the bayonet pins 18, the line contact will be changed to a point contact; that is to say that some portion of the cantilevered ground strap portion 28 will in all cases contact a portion of the bulb base 38 for any rotated position. Similarly, there will be a positive electrical contact between electrical contact 36 on the bulb and the cantilevered portion of the contact strip 30. As shown most clearly in FIG. 2, the contact strip extends in a substantially normal fashion from the first surface 2 through the bottom of the concave recess at 32, and into the outwardly open recess defined between the first and second extensions 6 and 8, respectively. As shown in FIGS. 1 and 2, the housing base 2 is illustrated to be circular, with the bulb 10 being supported so that the filament end is proximate the geometric center of the substantially circular first surface 2. To ensure that the bulb is positioned for the optimum optical advantage, the inner end of the bulb support 4 terminates proximate, but radially outward from the geometric center of the substantially circular first surface 2.

Again, with reference to FIG. 1, it can be seen that the distance between the oppositely disposed extensions 6 and 8 is less than the distance from the top of the extensions to the bottom of the concave channel recess. As a consequence, as most clearly shown in FIG. 2, the concave recess is operable to allow the bayonet base light bulb to pivot about its pins 18, which are held within the outwardly open apertures 16. When the bulb base 38 self pivots about the pins 18, there will be a wiping action between the ground strap and the base, at 40, and also a wiping action between the bulb base 36 and the cantilevered portion of the contact strip at 30. Furthermore, the electrical contact strip 30 is laterally disposed, with respect to the aperture 16, at a distance less than the dimension between the base of the bulb 30 and the bulb pins 18. Therefore, there will be a resilient urging of the cantilevered contact strip 30 against the base portion 36, as there is also a resilient urging between the ground strap 28 and the bulb base 38, as indicated at 40 in FIG. 2. The contact strip 30 further includes a portion extending normally through the housing base 2, to terminate as an exposed electrical contact connection, shown at 34. The ground strap 12 and the contact strip 30 are preferably phosphrous bronze to ensure adequate resiliency and good electrical conductivity. Of course any other resilient metal strip would be equivalent, provided the geometry is essentially as shown in FIG. 2 and herein described.

Figure 3:
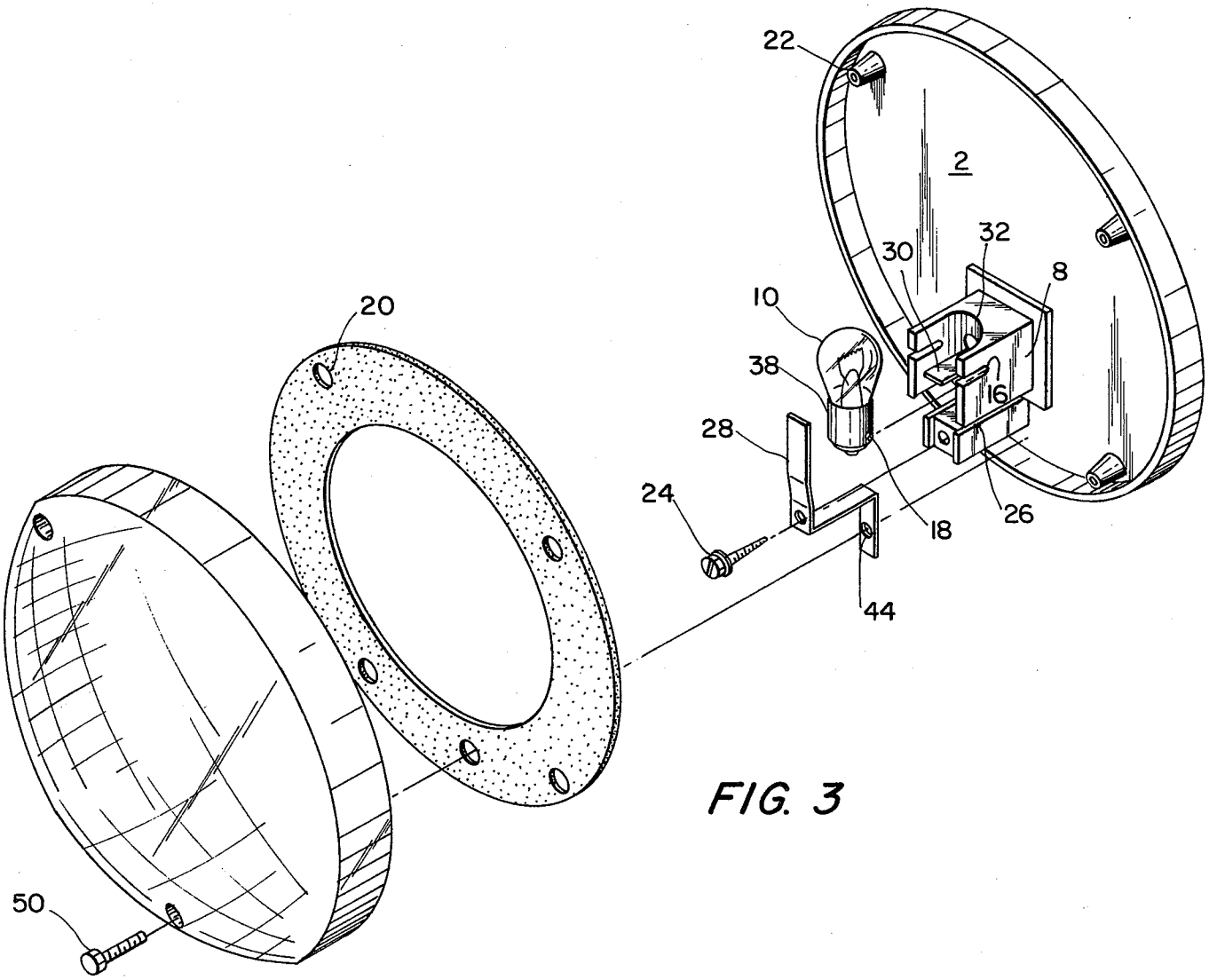
FIG. 3 is an explosion view illustrating further features according to the preferred embodiment of the present invention.

FIG. 3 illustrates the entire assembly of the vehicle lamp, wherein there is additionally a refractive lens superposed upon the first surface of the housing at 2. FIG. 3 illustrates, in explosion view, a final assembly of a conventional refractive lens open the molded lamp housing of the present invention. The bulb 10 is normally inserted into the apertures 16 so that the base of the bulb will slightly distend the cantilevered contact strip 30. When the bulb 10 is partially inserted into the concave recess 32, the bulb 10 will be supported only by contact of the bayonet pins 18 within the apertures 16, and urged radially inward by a contact between the contact strip 30 and the base of the bulb. Upon such insertion of the bulb 10, the cantilevered portion of the ground strap 28 is aligned with the base of the bulb 38, and a ground strap mounting screw 24 is inserted into the lamp support extension 26. The ground strap 12 further includes a portion extending upon and towards an edge of the first surface, with a mounting aperture 44 in the grounding strap. As shown most clearly in FIG. 2, the diameter of the ground strap aperture 44 is less than a corresponding vehicle body mounting aperture 46 extending through the housing base 2. Additionally, the gasket 20 includes a gasket aperture which is of greater diameter than the aligned aperture 44 within the ground strap 12. With this arrangement a grounding screw 50 may be tightened down upon ground strap 12 through the housing mounting aperture 46, and into a metallic portion of a vehicle, shown at 48. With this arrangement a secure ground connection between the ground strap 12 and the body of the vehicle 48 is ensured. FIG. 3 illustrates that the grounding screw 50 may be inserted after the superposed refractive lens is in place, a result simply obtained by ensuring that the access hole in the refractive lens is larger than the diameter of the head of the ground screw 50. When the housing base 2 is of a substantially circular configuration, as shown in this preferred embodiment, the concave recess 32 is preferably diametrically aligned upon the circular surface, simply to ensure that the best optical performance will be obtained by the bulb 10 which is so held. Of course, if an oval, square or other shaped housing base is employed, the bulb support assembly 4 may simply be formed in any suitable relative orientation to the housing base 2 to ensure that the filament portion of the bulb 10 is positioned at the desired point. The bulb support base 4 may further include, as shown in FIG. 2, a centrally located relief hole at 42. Within this relief hole at 42, there may optionally be positioned a coiled spring to urge the base of the bulb 38 upwardly towards the contact strip 28. However, the distance between the bulb socket mount extensions 6 and 8 effectively holds the base of the bulb 38, and since there is a slight space between the relative bottom of the bulb base 38 and the top of the concave recess 32, the present invention allows the entire bulb 10 to vibrate sympathetically with the vehicle to ensure wiping of the two electrical contact areas. Because this wiping would be fairly regular, during normal road operation, corrosion will be effectively prevented from building up at the contact point 40 and the contact point at 36. Unlike prior art devices, there is no intent to maintain the bulb base 38 in an encompassing cylindrical metal sleeve, wherein the grounding connection is assured only between the bayonet pin 18 and any surrounding cylindrical metal grounding socket. Rather, the present invention ensures a resiliently urged grounding connection at 40, together with a resiliently urged contact at the base of the bulb 36. The geometry of the present bulb support ensures that there will be a slight movement of the bulb 10 within the concave recess 32, so that inevitable corrosion will be constantly wiped from the respective contact areas.

It is apparent that though one preferred embodiment of the present invention has been described, changes and modifications can be made therein without departing from the spirit of the invention which is expressed solely by the appended claims.

We claim:

1. A molded lamp housing operable for vehicular mounting comprising, in combination:

A. A housing base of electrically insulating material comprising a first surface having an integrally formed bulb support extending outwardly therefrom, wherein;

B. said bulb support further comprises a concave channel recess, substantially parallel to said first surface, and defined by a pair of oppositely disposed extensions, said channel being outwardly open relative to said first surface, and;

C. an outwardly open aperture extending inwardly from an outer surface on each of said pair of extensions, said apertures being oppositely disposed and operable to receive pins on a bayonet base light bulb inserted partially into said channel, and;

D. a resilient, electrically conductive ground strap comprising a cantilevered portion extending above and in substantial parallel alignment with said concave channel recess, and;

E. an electrically conductive contact strap, extending in a substantial normai fashion from said first surface, and cantilevered into said channel at a point laterally disposed with respect to said pair of apertures, whereby said bulb support is operable to urge a portion of the base of a bayonet base light bulb into contact with said cantilevered ground strap, while maintaining further electrical contact between a bottom electrical contact on said bulb and said contact strip for various rotative orientations of said so held bulb about said pins.

2. A molded lamp housing as in claim 1 wherein said housing base further comprises a substantially circular first surface, and said concave channel recess is diametrically aligned with respect to said surface.

3. A molded lamp housing according to claim 2 wherein said concave recess has a radially inner end terminating proximate, but radially outward, from the geometric center of said substantially circular first surface.

4. A molded lamp housing according to claim 1 wherein the distance between said pair of oppositely disposed extensions is less than the distance from the top of said extensions to the bottom of said concave channel recess, whereby said bulb support is operable to allow a bayonet base light bulb to pivot about its pins so held by said apertures.

5. A molded lamp housing as in claim 3 wherein said cantilevered ground strap is rigidly fixed to said bulb support at a point radially outward with respect to the radially outward end of said concave recess.

6. A molded lamp housing as in claim 5 wherein the cantilevered extensions of said ground strap terminates radially inward from said oppositely disposed apertures.

7. A molded lamp housing as in claim 1 wherein said electrically conductive ground strap includes a portion extending upon and towards an edge of said first surface.

8. A molded lamp housing according to claim 7 wherein said edge of said first surface includes a vehicle body mounting aperture extending normally through said housing base and in alignment with a corresponding mounting aperture in said grounding strap.

9. A molded lamp housing as in claim 1 wherein said molded lamp housing includes a refractive lens superposed upon said first surface.

10. A molded lamp housing as in claim 8 wherein said molded lamp housing includes a refractive lens superposed upon said first surface with an access aperture aligned with and of larger diameter than said mounting aperture.

11. A molded lamp housing as in claim 7 wherein said housing base further comprises a substantially circular first surface, and said concave channel recess is diametrically aligned with respect to said surface.

12. A molded lamp housing as in claim 1 wherein said normally disposed contact strip is laterally disposed, with respect to said pair of apertures, at a distance less than the dimension between said bottom bulb contact and said bulb pins.

13. A molded lamp housing as in claim 1 wherein said ground strap includes a portion extending upon and towards an edge of said first surface, and said contact strip extends normally through said housing base to terminate as an exposed external electrical contact connection.

14. A molded lamp housing as in claim 7 wherein said contact strip extends normally through said housing base to terminate as an exposed external electrical contact connection.

15. A molded lamp housing as in claim 10 wherein said contact strip extends normally through said housing base to terminate as an exposed external electrical contact connection.

16. A molded lamp housing as in claim 10 wherein an insulating gasket is interposed on said first surface, around said housing edge, and between said lens and said first surface, wherein said gasket includes a gasket aperture, aligned with said mounting aperture, and of a diameter at least as great as said lens access aperture.

* * * * *